US007654091B2

(12) United States Patent
Al-Roub et al.

(10) Patent No.: US 7,654,091 B2
(45) Date of Patent: Feb. 2, 2010

(54) METHOD AND APPARATUS FOR COOLING GAS TURBINE ENGINE COMBUSTORS

(75) Inventors: Marwan Al-Roub, West Chester, OH (US); Steven Vise, Loveland, OH (US)

(73) Assignee: General Electric Company, Schenectady, NY (US)

( * ) Notice: Subject to any disclaimer, the term of this patent is extended or adjusted under 35 U.S.C. 154(b) by 342 days.

(21) Appl. No.: 11/468,486

(22) Filed: Aug. 30, 2006

(65) Prior Publication Data

US 2008/0053102 A1 Mar. 6, 2008

(51) Int. Cl.
*F02C 7/22* (2006.01)

(52) U.S. Cl. ..... 60/776; 60/748; 60/756

(58) Field of Classification Search ..... 60/748, 60/752, 737, 740, 746, 747, 754, 756, 757, 60/776

See application file for complete search history.

(56) References Cited

U.S. PATENT DOCUMENTS 4,454,711 A * 6/1984 Ben-Porat ..... 60/800
5,623,827 A * 4/1997 Monty ..... 60/748
6,442,940 B1 9/2002 Young et al.
6,530,227 B1 * 3/2003 Young et al. ..... 60/776
6,546,732 B1 4/2003 Young et al.
6,651,439 B2 11/2003 Al-Roub et al.
6,932,093 B2 * 8/2005 Ogden et al. ..... 134/22.1
6,973,419 B1 * 12/2005 Fortin et al. ..... 703/8
2003/0061815 A1 * 4/2003 Young et al. ..... 60/748
2005/0178126 A1 * 8/2005 Young et al. ..... 60/747
2006/0064983 A1 * 3/2006 Currin et al. ..... 60/748
2008/0295519 A1 * 12/2008 Park ..... 60/740

* cited by examiner

*Primary Examiner*—Michael Cuff
*Assistant Examiner*—Phutthiwat Wongwian
(74) *Attorney, Agent, or Firm*—William Scott Andes, Esq.; Armstrong Teasdale LLP

(57) ABSTRACT

A method for operating a gas turbine engine includes channeling fluid from a cooling fluid source to a combustor that includes at least one deflector and flare cone. The deflector and flare cone are coupled together and are configured to define a cooling fluid channel therebetween. The flare cone has a plurality of cooling injectors extending therethrough. The plurality of injectors are spaced circumferentially about a centerline axis of the flare cone and are coupled in flow communication with the fluid source. The plurality of injectors has a plurality of first injectors and a plurality of second injectors. The method also includes directing a portion of the fluid through the plurality of first injectors. The method further includes directing a portion of the fluid through the plurality of second injectors, wherein the first plurality of injectors facilitates cooling a portion of the deflector more than the second plurality of injectors.

19 Claims, 6 Drawing Sheets

METHOD AND APPARATUS FOR COOLING GAS TURBINE ENGINE COMBUSTORS

BACKGROUND OF THE INVENTION

This application relates generally to gas turbine engines and, more particularly, to combustors for gas turbine engines.

At least some known combustors include at least one mixer assembly coupled to a combustor liner that defines a combustion zone. Fuel injectors are coupled to the combustor in flow communication with the mixer assembly for supplying fuel to the combustion zone. Specifically, in such designs, fuel enters the combustor through the mixer assembly. The mixer assembly is coupled to the combustor liner by a dome plate or a spectacle plate.

At least some known mixer assemblies include a flare cone. Generally, the flare cone is divergent and extends radially outward from a centerline axis of the combustor to facilitate mixing the air and fuel, and to facilitate spreading the mixture radially outwardly into the combustion zone. A divergent deflector extends circumferentially around, and radially outward from the flare cone. The deflector, sometimes referred to as a splash plate, facilitates preventing hot combustion gases produced within the combustion zone from impinging upon the dome plate.

During operation, fuel discharged to the combustion zone may form a fuel-air mixture along the flare cone and the deflector. This fuel-air mixture may combust resulting in high gas temperatures. Prolonged exposure to the increased temperatures may increase a rate of oxidation formation on the flare cone, and may result in deformation of the flare cone and the deflector.

To facilitate reducing operating temperatures of the flare cone and the deflector, at least some known combustor mixer assemblies supply convective cooling air via air injectors defined within the flare cone. Specifically, in such combustors, the cooling air is supplied into a gap extending circumferentially around the combustor centerline axis between the flare cone and the deflector. However, at least some known deflectors have geometries which are not conducive to distributing cooling air around the deflector, and as such, temperature differentials may develop.

BRIEF SUMMARY OF THE INVENTION

In one aspect, a method for operating a gas turbine engine is provided. The method includes channeling a cooling fluid from a cooling fluid source to a combustor that includes at least one deflector and at least one flare cone. The deflector and the flare cone are coupled together and are configured to define a cooling fluid channel therebetween. The flare cone has a plurality of cooling injectors extending through a portion of the flare cone. The plurality of cooling injectors are spaced circumferentially about a centerline axis of the flare cone and are coupled in flow communication with the cooling fluid source. The plurality of cooling injectors has a plurality of first cooling injectors and a plurality of second cooling injectors. The method also includes directing a portion of the cooling fluid through the plurality of first cooling injectors. The method further includes directing a portion of the cooling fluid through the plurality of second cooling injectors, wherein the first plurality of cooling injectors facilitates cooling a portion of the deflector more than the second plurality of cooling injectors.

In another aspect, a cone assembly for a combustor is provided The cone assembly includes a deflector and a flare cone coupled to the deflector. The flare cone includes a plurality of cooling injectors extending through a portion of the flare cone. The cooling injectors are spaced circumferentially about a centerline axis of the flare cone and are coupled in flow communication with a cooling fluid source. The plurality of cooling injectors includes a plurality of first cooling injectors and a plurality of second cooling injectors. The plurality of first cooling injectors facilitate cooling a portion of the deflector more than the plurality of second cooling injectors.

In a further aspect, a gas turbine engine is provided. The gas turbine engine includes a compressor and a combustor coupled in flow communication with the compressor. The combustor includes a cone assembly. The cone assembly includes a deflector and a flare cone coupled to the deflector. The flare cone includes a plurality of cooling injectors extending through a portion of the flare cone. The cooling injectors are spaced circumferentially about a centerline axis of the flare cone and are coupled in flow communication with a cooling fluid source. The plurality of cooling injectors includes a plurality of first cooling injectors and a plurality of second cooling injectors. The plurality of first cooling injectors facilitate cooling a portion of the deflector more than the plurality of second cooling injectors.

DETAILED DESCRIPTION OF THE INVENTION

Figure 1:
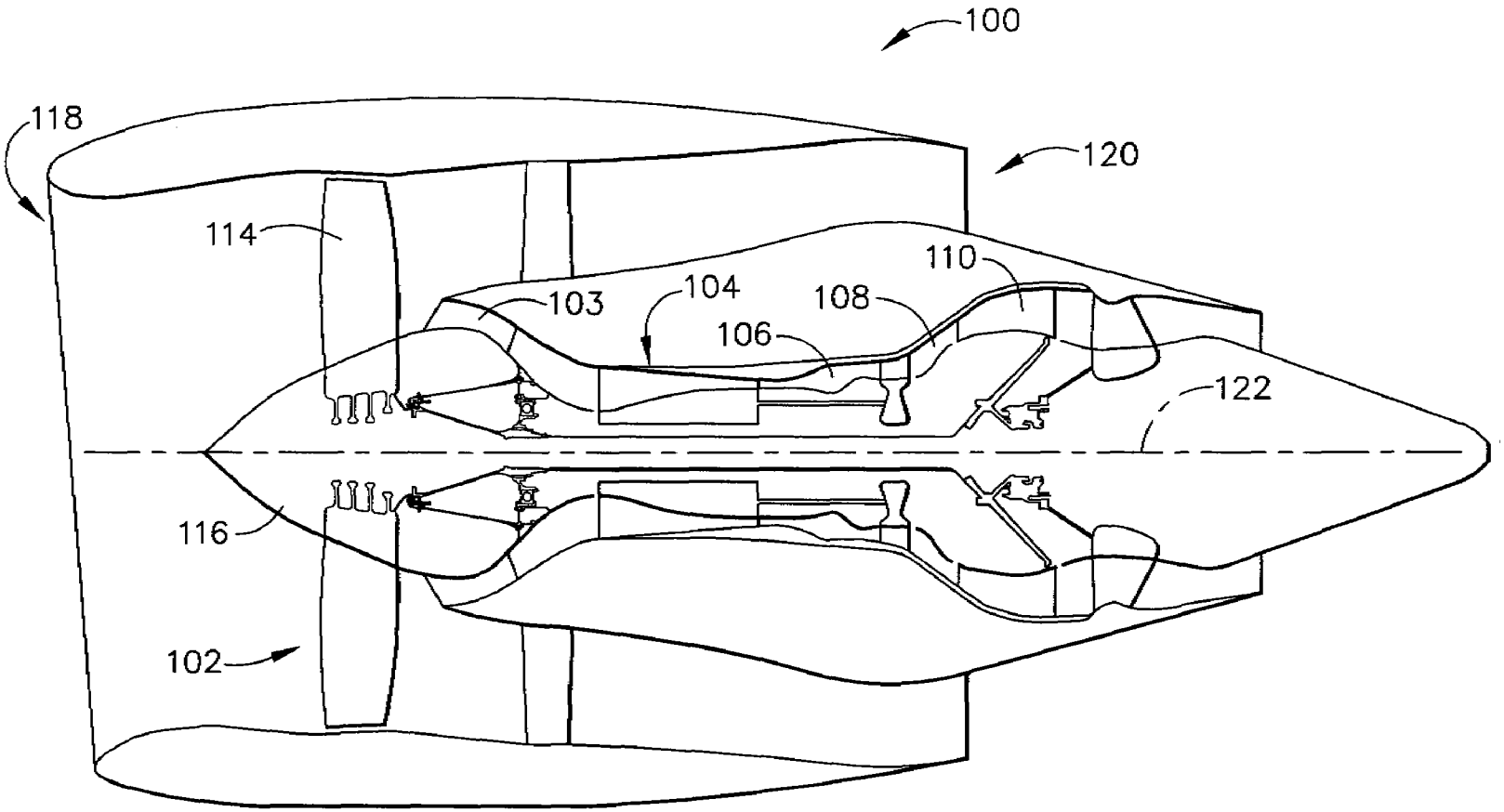
FIG. 1 is a schematic view of an exemplary gas turbine engine.

FIG. 1 is a schematic view of an exemplary gas turbine engine 100 including a fan assembly 102, a booster 103, a high-pressure compressor 104, and a combustor 106. Fan assembly 102, booster 103, compressor 104, and combustor 106 are coupled in flow communication. Engine 100 also includes a high-pressure turbine 108 coupled in flow communication with combustor 106 and a low-pressure turbine 110. Fan assembly 102 includes an array of fan blades 114 extending radially outward from a rotor disc 116. Engine 100 has an intake side 118 and an exhaust side 120. Engine 100 further includes a centerline 122 about which fan 102, booster 103, compressor 104, and turbines 108 and 110 rotate.

In operation, air enters engine 100 through intake 118 and is channeled through fan assembly 102 into booster 103. Compressed air is discharged from booster 103 into high-pressure compressor 104. Highly compressed air is channeled from compressor 104 to combustor 106 where fuel is mixed with air and the mixture is combusted within combustor 106. High temperature combustion gases generated are channeled to turbines 108 and 110. Turbine 108 drives compressor 104, and turbine 110 drives fan assembly 102 and booster 103. Combustion gases are subsequently discharged from engine 100 via exhaust 120.

Figure 2:
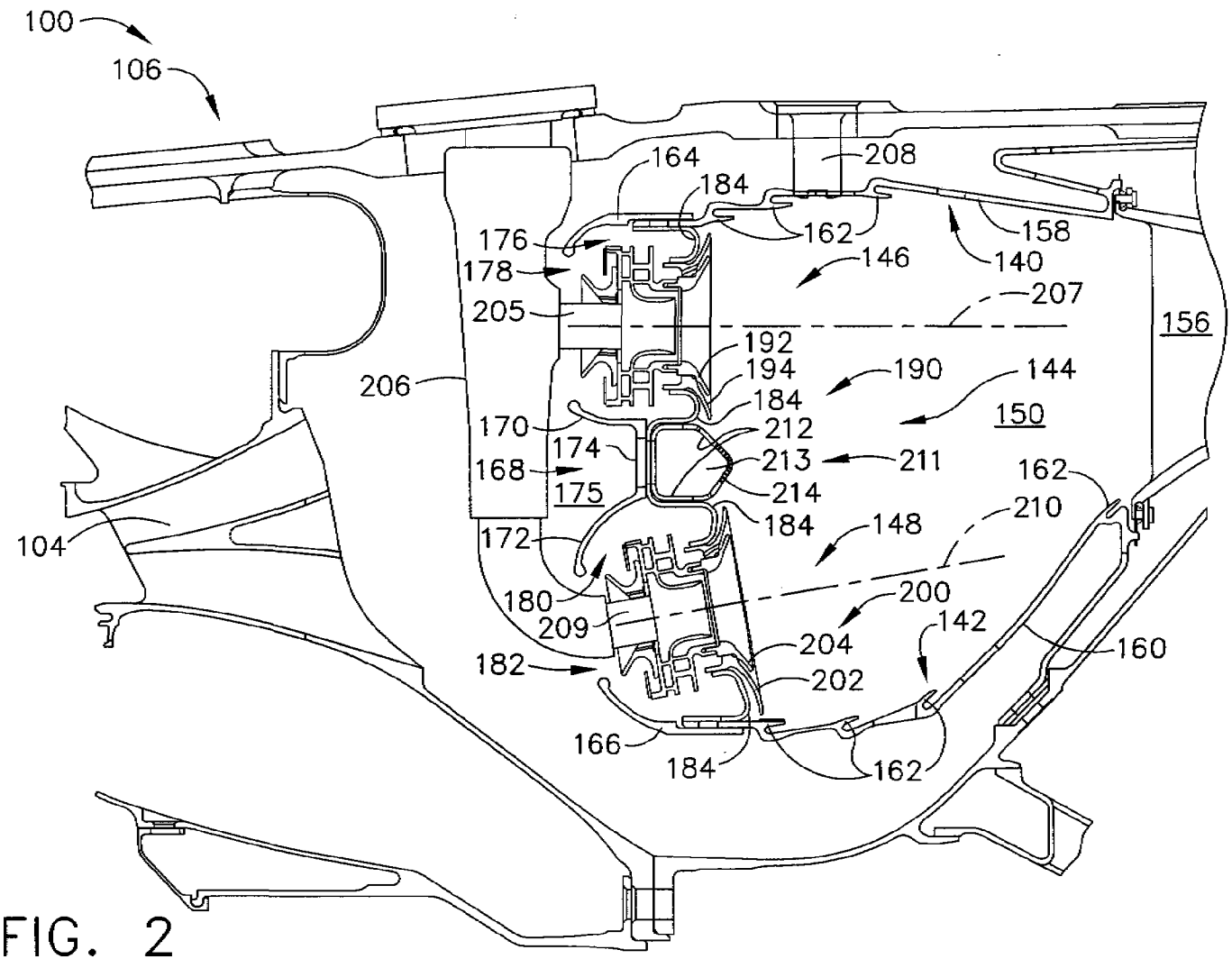
FIG. 2 is an enlarged cross-sectional view of a portion of the gas turbine engine shown in FIG. 1.

FIG. 2 is an enlarged cross-sectional view of a portion of gas turbine engine 100. Combustor 106 extends annularly about engine centerline 122 (shown in FIG. 1) and includes an annular outer liner 140 and an annular inner liner 142. Liners 140 and 142 define a substantially annular combustion chamber 150 therebetween. In the exemplary embodiment, engine 100 includes an annular dome 144 mounted upstream from outer and inner liners 140 and 142, respectively. Dome 144 defines an upstream end of combustion chamber 150. A radially outer mixer assembly 146 and a radially inner mixer assembly 148 are coupled to dome 144. In the exemplary embodiment, assemblies 146 and 148 are arranged in a double annular configuration (DAC). Alternatively, assemblies 146 and/or 148 may be arranged in a single annular configuration (SAC) or may form a portion of a triple annular configuration.

Outer and inner liners 140 and 142 extend downstream from dome 144 to a turbine nozzle 156. In the exemplary embodiment, outer and inner liners 140 and 142, respectively, each include a plurality of panels 158 and 160, respectively, and each also includes a series of steps 162, each of which forms a distinct portion of combustor liners 140 and 142. Mixer assemblies 146 and 148 are coupled in flow communication with turbine nozzle 156 via combustion chamber 150.

Combustor 106 includes an outer cowl 164 and an inner cowl 166. Outer cowl 164 and inner cowl 166 are each coupled to portions of panels 158 and 160, respectively. More specifically, outer and inner liner panels 158 and 160, respectively, are coupled serially to, and extend downstream from, cowls 164 and 166, respectively. Outer cowl 164 extends annularly in combustor 106 about mixer 146 and inner cowl 166 extends annularly in combustor 106 about mixer 148. Combustor 106 also includes an annular center cowl 168 that includes an outer cowl portion 170, an inner cowl portion 172, and a center portion 174. Portions 170 and 172 are coupled to portion 174 and all three portions 170, 172, and 174 define an annular cavity 175 therebetween. Cowl 164 and center cowl portion 170 at least partially define an outer mixer cavity 176 and an annular entrance 178. Similarly, cowl 166 and cowl portion 172 at least partially define an inner mixer cavity 180 and entrance 182. Compressor 104 is coupled in flow communication with mixer 146 via entrance 178 and cavity 176. Similarly, compressor 104 is coupled in flow communication with mixer 148 via entrance 182 and cavity 180.

Combustor 106 also includes a dome plate 184 that extends annularly about engine centerline 122 upstream of combustion chamber 150. Dome plate 184 is coupled to liners 140 and 142 and provides structural support to mixers 146 and 148. A plurality of openings (not shown in FIG. 2) are defined within dome plate 184 and are sized to receive mixers 146 and 148. Specifically, dome plate 184 facilitates securing mixer assemblies 146 and 148 in position within combustor 106.

Mixer 146 includes a cone assembly 190 having a deflector portion 192 and a flare cone portion 194. Similarly, mixer 148 includes a cone assembly 200 that further includes a deflector portion 202 and a flare-cone portion 204. In the exemplary embodiment, mixers 146 and 148 are substantially identical.

Mixer assembly 146 is supplied fuel via a fuel injector 205 that is supplied fuel via fuel supply line 206. Line 206 is connected to a fuel source (not shown in FIG. 2). Fuel injector 205 extends through mixer 146. More specifically, fuel injector 205 extends through mixer entrance 178 and discharges fuel (not shown in FIG. 2) in a direction that is substantially parallel to a longitudinal axis of symmetry 207 extending through mixer 146. Combustor 106 also includes a fuel igniter (not shown in FIG. 2) that extends into combustion chamber 150 downstream from mixers 146 and 148 and is housed in igniter enclosure 208. Similarly, mixer assembly 148 is supplied fuel via fuel injector 209. Fuel injector 209 extends through mixer 148 and is coupled in flow communication with fuel supply line 206. More specifically, fuel injector 209 discharges fuel in a direction that is substantially parallel to a longitudinal axis of symmetry 210 of mixer 148.

Combustor 106 also includes a substantially annular flow center shield 211 positioned between mixers 146 and 148. Center shield 211 includes a plurality of walls 212 that defines an annular chamber 213 therein and that includes a plurality of air jets 214. Center shield 211 is coupled to dome plate 184 and cowl center portion 174 via walls 212. Cavity 175, cowl center portion 174, a portion of walls 212, center shield chamber 213, and air jets 214 are coupled in flow communication and define a passage for channeling air from high-pressure compressor 104 to combustion chamber 150. Air jets 214 split flames from mixer 146 and mixer 148 such that interaction between the two flames is mitigated. Moreover, air flow from compressor 104 to combustion chamber 150 via center shield 211 facilitates removing heat from cowl 168 and dome plate 184.

During operation, air discharged from high-pressure compressor 104 is channeled to combustor 106. Specifically, air is channeled into mixer cavity 176 via entrance 178 and into mixer cavity 180 via entrance 182. Fuel is channeled from a fuel source (not shown in FIG. 2) into fuel injector 205 via fuel line 206 and is discharged towards combustion chamber 150. Air and fuel are mixed within mixers 146 and 148 and the fuel/air mixtures are ejected into combustion chamber 150 in a direction substantially parallel to mixer centerlines 207 and 210, respectively. Center shield 211 facilitates separating the flames associated with mixers 146 and 148, and combustion is facilitated within combustion chamber 150. The associated combustion gases are subsequently channeled to turbine nozzle 156.

Figure 3:
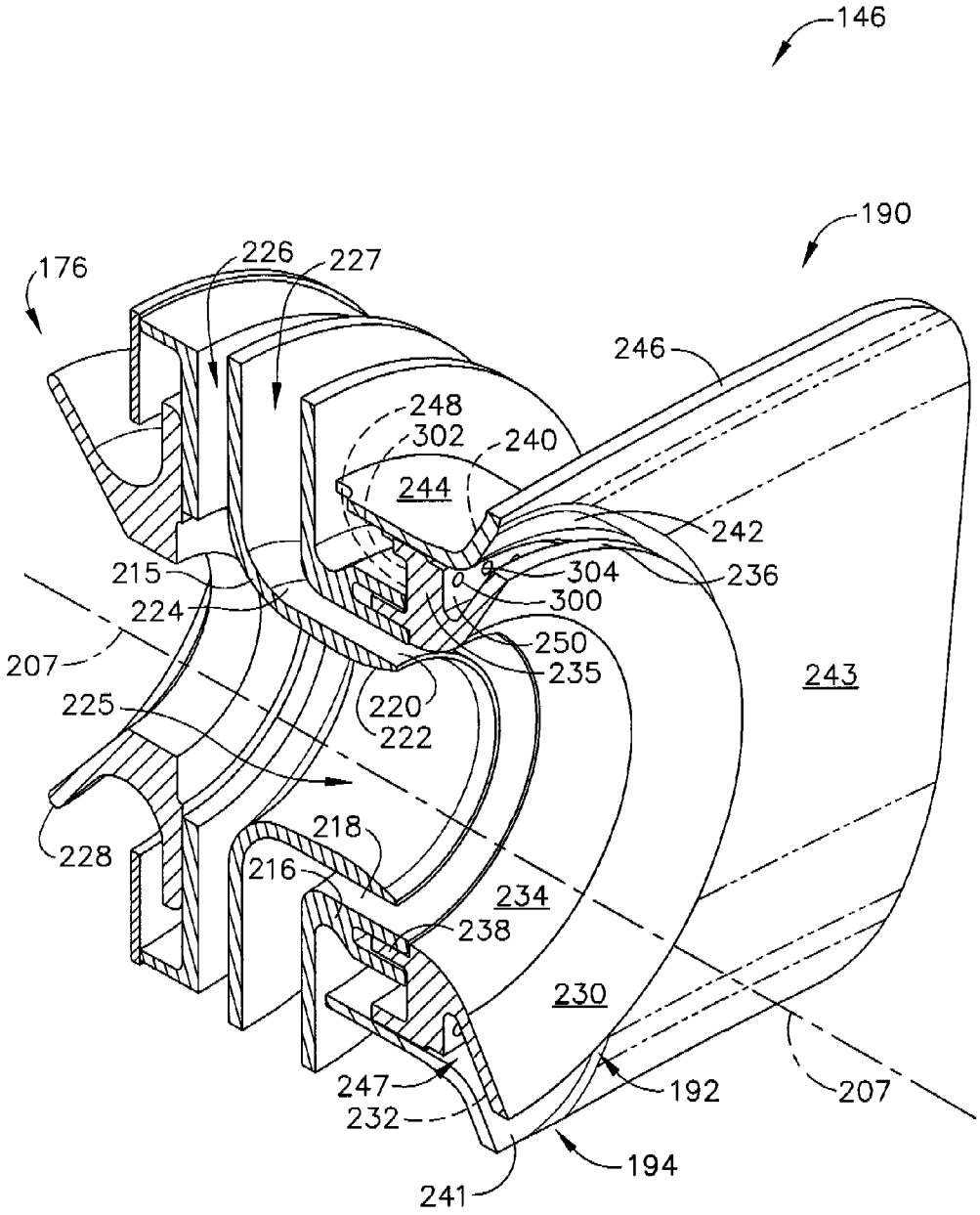
FIG. 3 is a perspective view of a portion of an exemplary combustor cone assembly that may be used with the gas turbine engine shown in FIG. 2.
Figure 4:
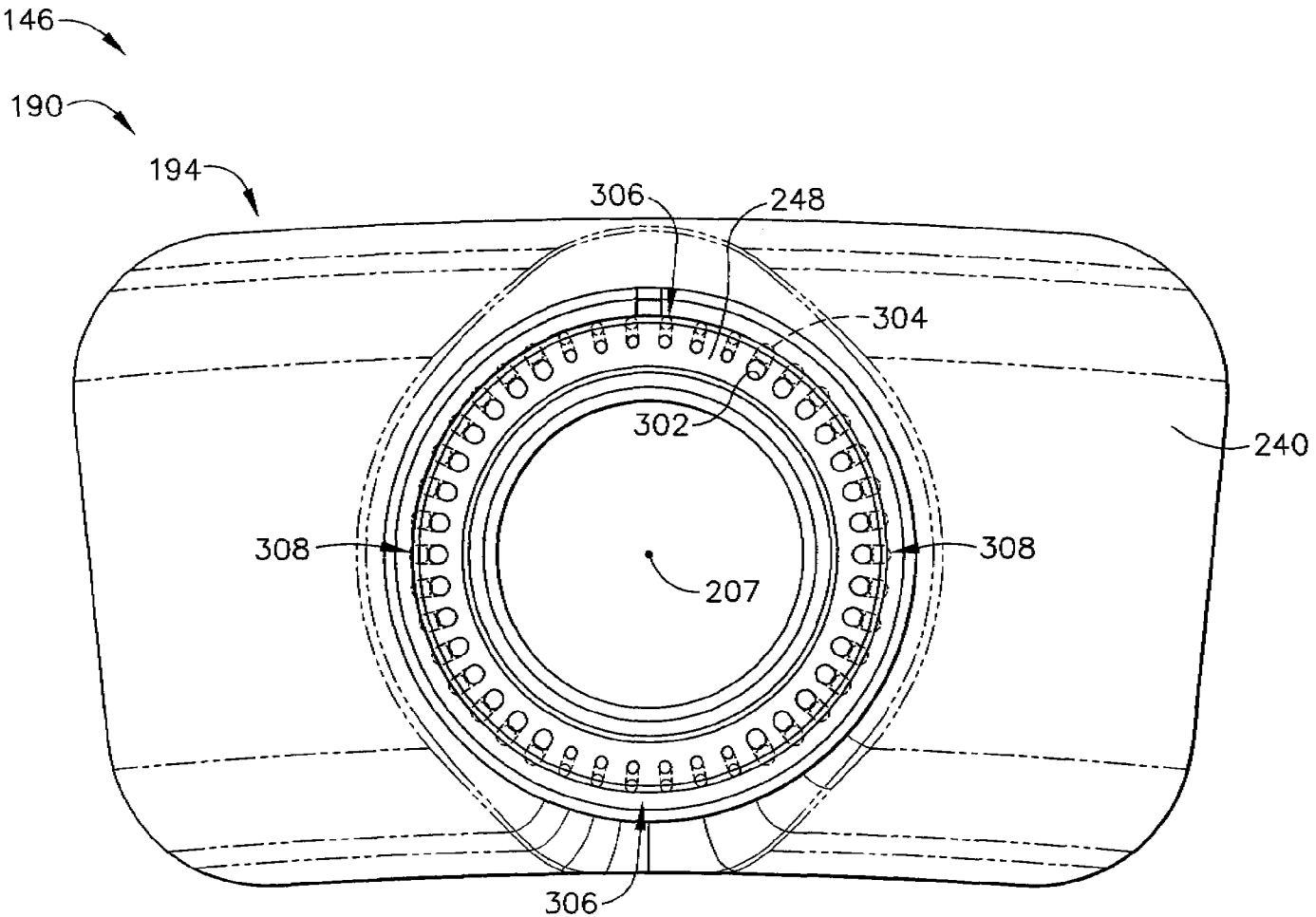
FIG. 4 is an end view of the combustor cone assembly shown in FIG. 3.
Figure 5:
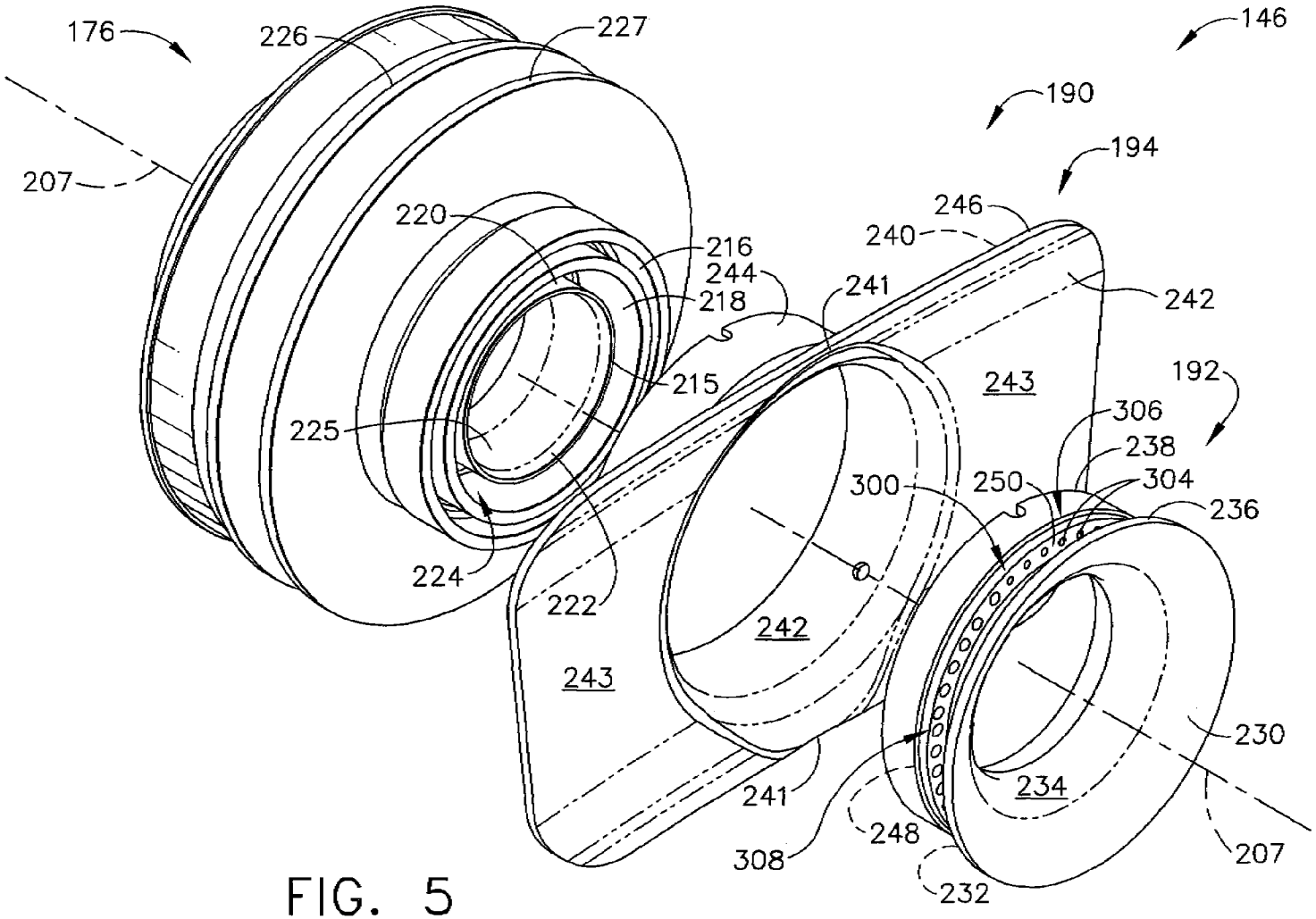
FIG. 5 is an exploded view of the combustor cone assembly shown in FIG. 3.

FIG. 3 is a perspective view of a portion of cone assembly 190. FIG. 4 is an end view of cone assembly 190. FIG. 5 is an exploded view of cone assembly 190. FIGS. 3, 4 and 5 are referenced together for the following discussion. Mixer 146 assembly and operation are discussed in detail below and mixer 148 (shown in FIG. 2) is assembled and operated in a similar manner. Mixer 146 includes an annular air swirler 215 having an annular exit cone 216 that is positioned substantially symmetrically about longitudinal axis of symmetry 207. Exit cone 216 includes a radially inwardly facing flow surface 218. Air swirler 215 includes a radially outer surface 220 and a radially inwardly facing flow surface 222. Flow surfaces 218 and 220 define an aft venturi channel 224 used for channeling a portion of air downstream. Surface 222 defines a chamber 225, typically and hereon referred to as venturi 225. Air swirler 215 also includes a plurality of circumferentially-spaced forward swirl vanes 226 and aft swirl vanes 227 which impart a plurality of opposing swirling motions on at least a portion of air flowing through mixer 146 to facilitate fuel and air mixing. Mixer 146 also includes a tubular ferrule 228. A portion of fuel injector 205 is slidably disposed within ferrule 228 to accommodate axial and radial movement due to thermal growth differentials between fuel injector 205 and ferrule 228.

Cone assembly 190 is coupled to air swirler 215. Specifically, flare cone portion 192 couples to exit cone 216 and extends downstream from exit cone 216. More specifically, flare cone portion 192 includes a radially inner flow surface 230 and a radially outer surface 232. When flare cone portion 192 is coupled to exit cone 216, radially inner flow surface 230 is positioned substantially co-planar with exit cone flow surface 218. Specifically, flare cone inner flow surface 230 is divergent such that flare cone inner flow surface 230 extends radially outwardly from an elbow 234 of flare cone body 235 to a trailing end 236 of flare cone portion 192. More specifically, flare cone outer surface 232 is substantially parallel to inner surface 230 between trailing edge 236 and elbow 234.

Deflector portion 194 facilitates preventing hot combustion gases from impinging upon combustor dome plate 184. Deflector portion 194 also includes a radially outer surface 240 and a radially inner surface 242. Radially outer surface 240 and radially inner surface 242 extend from deflector leading edge 244 across deflector 194 to deflector trailing edge 246. Deflector radially inner surface 242 includes two radially-narrow regions 241 and two radially-wide regions 243. A substantially annular gap 247 is defined between radially outer surface 232 and at least a portion of deflector inner surface 242.

Flare cone body 235 includes a forward surface 248 and an aft surface 250. A plurality of cooling injectors 300 are defined within and extend axially through, flare cone body 235. More specifically, injectors 300 extend from an entrance 302 defined within flare cone body forward surface 248 to an exit 304 defined within flare cone body aft surface 250. Entrance 302 is upstream from exit 304 such that injectors 300 discharge cooling fluid therethrough at a reduced pressure. In one embodiment, the cooling fluid is compressed air channeled from compressor 104. Alternatively, the cooling fluid may be from any source that facilitates cooling as described herein.

Injectors 300 extend radially outward with respect to axis 207 and from forward entrance 302 to aft exit 304. In the exemplary embodiment, injectors 300 include a plurality of injectors having different discharge diameters. Specifically, in the exemplary embodiment, there are two groups of injectors 300, i.e., a small-diameter group 306 and a large-diameter group 308. More specifically, in the exemplary embodiment, the diameter associated with group 306 is approximately 0.889 millimeters (mm) (0.0350 inches (in) and the diameter associated with group 308 is approximately 1.433 mm (0.0564 in). Moreover, in the exemplary embodiment, injectors 300 are arranged such that two circumferentially opposite groups 306 are positioned to inject cooling fluid towards radially narrow regions 241 of deflector inner surface 242 and there are two circumferentially opposite groups 308 to inject cooling fluid towards radially widest regions 243 of deflector inner surface 242. The differing diameters associated with injector groups 306 and 308 facilitate biasing cooling fluid flow over deflector 194. Specifically, the differing diameters facilitate injecting differing cooling fluid mass flow rates across differing regions 241 and 243 of deflector surface 242. More specifically, injector groups 308 inject cooling fluid at a greater predetermined mass flow rate across regions 243 than injector groups 306 inject across regions 241. Alternatively, any diameters arranged in any configuration that attain predetermined operating parameters may be used.

In the exemplary embodiment, flare cone 192 and deflector 194 are fabricated independently. The methods of fabrication include, but are not limited to, casting. Subsequently, injectors 300 are formed using methods that include, but are not limited to, known electrical discharge machining (EDM) method. Alternatively, injectors 300 may be formed within flare cone 192 during casting. Also, alternatively, flare cone 192 and deflector 194 may be formed as an integral, unity flare cone-deflector assembly 190 via methods that include, but are not limited to, casting.

During operation, forward swirler vanes 226 swirl air in a first rotational direction and aft swirler vanes 227 swirl air in a second rotational direction that is opposite to the first rotational direction. Fuel discharged from fuel injector 205 (shown in FIG. 2) is injected into venturi 225 and is mixed with air being swirled by forward swirler vanes 226. This initial fuel/air mixture is discharged aft from venturi 225 and is mixed with air swirled through aft swirler vanes 227 and channeled through aft venturi channel 224. The fuel/air mixture is spread radially outwardly due to the centrifugal effects of forward and aft swirler vanes 226 and 227, respectively, and flows along flare cone flow surface 230 and deflector portion flow surface 242 at a relatively wide discharge spray angle.

Cooling fluid is supplied to cone assembly 190 through cooling injector groups 306 and 308. Groups 306 and 308 facilitate channeling a continuous flow of cooling fluid to be discharged at a reduced pressure for impingement cooling of flare cone 192. The reduced pressure facilitates improved cooling and backflow margin for the impingement cooling of flare cone 192 via cooling fluid impingement on radially outer surface 232. Furthermore, the cooling fluid enhances convective heat transfer and facilitates reducing an operating temperature of flare cone 192. The reduced operating temperature facilitates extending a useful life of flare cone 192 via mechanisms that include, but are not limited to, mitigating a potential for heat-induced distortion and deleterious oxidation of flare cone 192.

Furthermore, as cooling fluid is discharged through injector groups 306 and 308, deflector 194 is film cooled. More specifically, injector groups 306 and 308 supply inner surface 242 with film cooling. Because groups 306 and 308 are disposed circumferentially about flare cone 192 and the cooling fluid impinges on radially outer surface 232, film cooling is directed along inner surface 242 circumferentially around flare cone 192. In addition, because groups 306 and 308 facilitate directed cooling flow as described above, cone assembly 190 facilitates optimizing film cooling across deflector regions 241 and 243. Specifically, the differing diameters associated with injector groups 306 and 308 facilitate biasing cooling fluid flow over deflector 194. More specifically, the differing diameters facilitate injecting differing cooling fluid mass flow rates across differing regions 241 and 243 of deflector surface 242. Even more specifically, injector groups 308 inject cooling fluid at a greater predetermined mass flow rate across regions 243 than injector groups 306 inject across regions 241. Therefore, preferential cooling of regions 241 and 243 is facilitated and temperature differentials between regions 241 and 243 are mitigated. Moreover, a reduction in temperature differentials between regions 241 and 243 mitigates inducing heat stresses between regions 241 and 243 that subsequently mitigates a potential for distortion of deflector 194. Furthermore, optimizing cooling fluid flow as described herein facilitates mitigating a potential for nitrogen oxides ($NO_x$) formation when the cooling fluid is air.

In the exemplary embodiment, radially outer surface 232 is positioned substantially parallel to a portion of inner surface 242. Therefore, in the exemplary embodiment, the distance between surface 242 and trailing edge 236 is substantially circumferentially constant and the cooling fluid mass flow rate is substantially biased by injector groups 306 and 308 sizing and positioning. Alternatively, flare cone 192 has a varying distance (not shown) between surface 242 and trailing edge 236 such that cooling fluid mass flow rates are further biased to facilitate a greater predetermined mass flow rate across regions 243 than across regions 241. Specifically, the distance of gap 247 between surface 242 and trailing edge 236 associated with regions 243 is greater than the distance of gap 247 associated with regions 241. Fabricating an integral, unitized cone assembly 190 as discussed above facilitates this alternative embodiment.

A method for operating gas turbine engine 100 includes channeling cooling fluid, i.e., air from a cooling fluid source, i.e., compressor 104, to combustors 106 that include at least one deflector 194 and at least one flare cone 192. Deflector 194 and flare cone 192 are coupled together and are configured to define cooling fluid channel 247, i.e., gap 247, therebetween. Flare cone 192 has a plurality of cooling injectors 300 extending through a portion of flare cone 192. Plurality of cooling injectors 300 are spaced circumferentially about centerline axis 207 of flare cone 192 and are coupled in flow communication with the cooling fluid source, i.e., compressor 104. Plurality of cooling injectors 300 includes plurality of first cooling injectors 308 and plurality of second cooling injectors 306. The method also includes directing a portion of the cooling fluid, i.e., compressed air, through plurality of first cooling injectors 308. The method further includes directing a portion of the compressed air through plurality of second cooling injectors 306, wherein first plurality of cooling injectors 308 facilitates cooling a portion of deflector 194 more than second plurality of cooling injectors 306.

Figure 6:
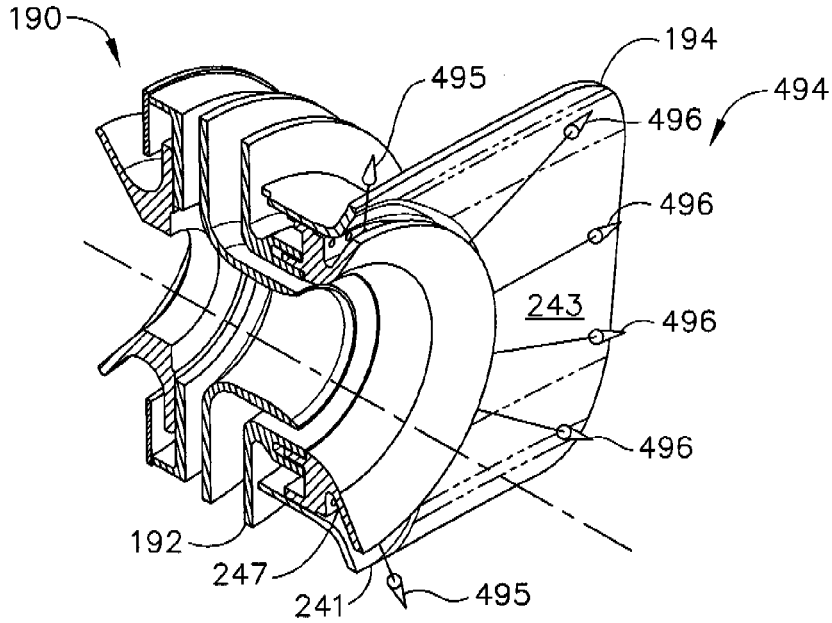
FIG. 6 is a cutaway view of the combustor cone assembly shown in FIG. 3.

FIG. 6 is a cutaway view of exemplary cone assembly 190 with preferentially biased deflector cooling as described herein. Assembly 190 includes deflector 194 that includes inner surface narrow region 241 and inner surface wide region 243. Assembly 190 also includes exemplary flare cone 192. Therefore, an air flow pattern 494 (illustrated as a plurality of arrows) generated by injectors 300 (shown in FIGS. 4 and 5) within flare cone 192 is channeled through gap 247. Pattern 494 includes a biased air flow 495 and a biased air flow 496 such that flow 496 is greater than flow 495 and a greater amount of cooling is biased towards region 243 as compared to region 241. Flow pattern 494 may be contrasted to some known cone assemblies that do not have preferentially biased deflector cooling as described herein such that the cooling flow bias is substantially mitigated and the flow to regions 241 and 243 are substantially similar.

Figure 7:
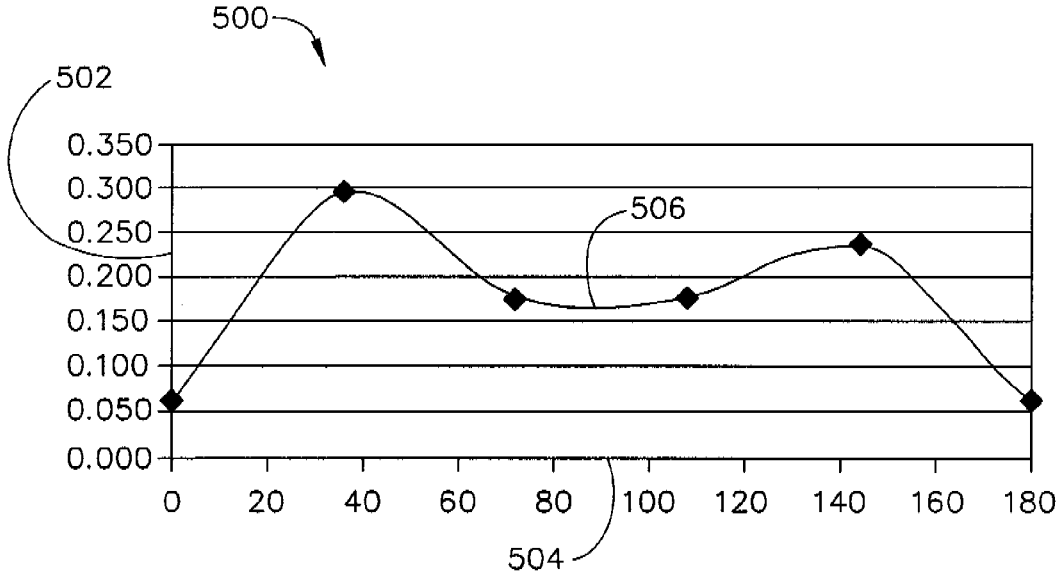
FIG. 7 is a graphical representation of an air flow pattern that may be generated using the combustor cone assembly shown in FIG. 6.

FIG. 7 is a graphical representation 500 of air flow pattern 494 that may be generated using cone assembly 190 (shown in FIG. 6). Graph 500 includes an ordinate (Y-axis) 502 that represents a fraction of a cooling fluid distribution as a function of circumferential position about gap 247 that is represented on the abscissa (X-axis) 504. X-axis 504 is referenced to a 180° arc that includes a 0° position that represents a twelve o-clock position of gap 247. X-axis 504, as referenced to the 180° arc, also includes a 180° position that represents a six o-clock position of gap 247. The 0° position extends to the 180° position in a rotationally clockwise direction. A plotted curve 506 of air flow pattern 494 at points taken every 36° about the 180° arc illustrate a smaller percentage of cooling flow through gap 247 across regions 241 as compared to regions 243. Plotted curve 506 may be contrasted to plotted curves that may be associated with air flow patterns of some known cone assemblies that do not have preferentially biased deflector cooling as described herein. Such cone assemblies may have the cooling flow bias substantially mitigated such that the air flow to regions 241 and 243 are substantially similar. The associated plotted curves for such cone assemblies have a slope that is substantially zero, i.e., the plot is substantially flat.

The methods and apparatuses for a combustor described herein facilitate operation of a gas turbine. More specifically, the combustor cone assembly as described above facilitates an efficient and effective combustor cooling mechanism. Also, the robust combustor cone assembly facilitates an extended operational life expectancy of combustor deflectors and flare cones. Such combustor deflector-flare cone assemblies also facilitate gas turbine reliability, and reduced maintenance costs and gas turbine outages.

Exemplary embodiments of combustor deflector-flare cone assemblies as associated with gas turbines are described above in detail. The methods, apparatus and systems are not limited to the specific embodiments described herein nor to the specific illustrated gas turbines.

While the invention has been described in terms of various specific embodiments, those skilled in the art will recognize that the invention can be practiced with modification within the spirit and scope of the claims.

What is claimed is:

1. A method for operating a gas turbine engine, said method comprising:

channeling cooling fluid from a cooling fluid source to a combustor that includes a dome plate, at least one deflector coupled to the dome plate and extending aft of the dome plate, and at least one flare cone coupled to the deflector and extending aft of the deflector, wherein the deflector and the flare cone are configured to define a cooling fluid channel therebetween, the flare cone having a plurality of cooling injectors extending therethrough, the plurality of cooling injectors spaced circumferentially about a centerline axis of the flare cone and coupled in flow communication with the cooling fluid source, the plurality of cooling injectors having a plurality of first cooling injectors and a plurality of second cooling injectors;

directing a portion of the cooling fluid through the plurality of first cooling injectors; and directing a portion of the cooling fluid through the plurality of second cooling injectors, wherein the plurality of first cooling injectors facilitates cooling a first portion of the deflector more than the plurality of second cooling injectors facilitates cooling a second portion of the deflector.

2. A method in accordance with claim 1 further comprising biasing a portion of the cooling fluid towards at least one pre-determined portion of the deflector.

3. A method in accordance with claim 2 wherein biasing a portion of the cooling fluid comprises:

channeling a first cooling fluid stream through the plurality of first cooling injectors, wherein each of the first cooling injectors discharges cooling fluid therefrom at a first flow rate;

directing at least a portion of the first cooling fluid stream discharged from the plurality of first cooling injectors over a first predetermined portion of the deflector; and channeling a second cooling fluid stream through the plurality of second cooling injectors, wherein each of the second cooling injectors discharges cooling fluid therefrom at a second fluid flow rate that is different than the first flow rate.

4. A method in accordance with claim 3 further comprising directing the second cooling fluid stream over a second predetermined portion of the deflector that is different than the first predetermined deflector portion.

5. A cone assembly for a combustor including a dome plate, said cone assembly comprising:

a deflector configured to be coupled to the dome plate and to extend aft of the dome plate; and a flare cone configured to be coupled to said deflector and to extend aft of said deflector, said flare cone comprising a plurality of cooling injectors extending therethrough, said plurality of cooling injectors spaced circumferentially about a centerline axis of said flare cone and configured to be coupled in flow communication with a cooling fluid source, said plurality of cooling injectors comprising a plurality of first cooling injectors and a plurality of second cooling injectors, said plurality of first cooling injectors configured to facilitate cooling a first portion of said deflector more than said plurality of second cooling injectors facilitates cooling a second portion of said deflector.

6. A cone assembly in accordance with claim 5 wherein said deflector comprises a first portion and a second portion, said plurality of first cooling injectors facilitate cooling said deflector first portion, said plurality of second cooling injectors facilitate cooling said deflector second portion such that heat stresses induced between said first and second deflector portions are facilitated to be reduced.

7. A cone assembly in accordance with claim 5 wherein said flare cone is radially inward from said deflector such that a substantially annular gap is defined therebetween.

8. A cone assembly in accordance with claim 7 wherein said gap has a substantially constant width.

9. A cone assembly in accordance with claim 7 wherein a width of said gap varies circumferentially about said centerline axis.

10. A cone assembly in accordance with claim 9 wherein said gap facilitates cooling at least a portion of said deflector and said flare cone.

11. A cone assembly in accordance with claim 5 wherein said flare cone is removably coupled to said deflector.

12. A cone assembly in accordance with claim 5 wherein said flare cone is formed integrally with said deflector.

13. A gas turbine engine comprising:

a compressor configured to channel compressed air; and a combustor coupled in flow communication with said compressor, said combustor comprising a dome plate and a cone assembly coupled to said dome plate, said cone assembly comprising a deflector extending aft of said dome plate and a flare cone coupled to said deflector and extending aft of said deflector, wherein said flare cone comprises a plurality of cooling injectors extending therethrough, said plurality of cooling injectors spaced circumferentially about a centerline axis of said flare cone and coupled in flow communication with and configured to receive the compressed air from said compressor, said plurality of cooling injectors comprises a plurality of first cooling injectors and a plurality of second cooling injectors, wherein said plurality of first cooling injectors facilitates cooling a first portion of said deflector more than said plurality of second cooling injectors facilitates cooling a second portion of said deflector.

14. A gas turbine engine in accordance with claim 13 wherein said flare cone is radially inward from said deflector such that a substantially annular gap is defined therebetween.

15. A gas turbine engine in accordance with claim 14 wherein the gap has a substantially constant width.

16. A gas turbine engine in accordance with claim 14 wherein a width of the gap varies circumferentially about the centerline axis.

17. A gas turbine engine in accordance with claim 16 wherein the gap facilitates cooling at least a portion of said deflector and said flare cone.

18. A gas turbine engine in accordance with claim 13 wherein said flare cone is removably coupled to said deflector.

19. A gas turbine engine in accordance with claim 13 wherein said flare cone is formed integrally with said deflector.

* * * * *